United States Patent [19]

Wilson

[11] 4,362,526

[45] Dec. 7, 1982

[54] METHOD OF MAKING PLASTIC HANDLE BAGS FROM CONTINUOUS WEB

[75] Inventor: James R. Wilson, Northport, N.Y.

[73] Assignee: Equitable Bag Co., Inc., Long Island City, N.Y.

[21] Appl. No.: 182,799

[22] Filed: Aug. 29, 1980

[51] Int. Cl.[3] ..... B31B 1/86

[52] U.S. Cl. ..... 493/226; 493/196; 493/214; 493/926; 493/328

[58] Field of Search ..... 493/226, 926, 193–197, 493/199, 203, 198, 214, 235, 231, 224, 328

[56] References Cited

U.S. PATENT DOCUMENTS

| | | | |
|---|---|---|---|
| 2,400,759 | 5/1946 | Katz | 493/926 X |
| 3,021,767 | 2/1962 | Hamilton | 493/226 X |
| 3,339,822 | 9/1967 | Pearl | 493/226 X |
| 3,451,316 | 6/1969 | Bagnall | 493/226 X |
| 3,858,789 | 1/1975 | Verbeke | 493/926 X |
| 4,018,142 | 4/1977 | Canno | 493/226 X |

FOREIGN PATENT DOCUMENTS

| | | | |
|---|---|---|---|
| 2356106 | 9/1973 | Fed. Rep. of Germany | 493/226 |
| 1018716 | 1/1953 | France | 493/926 |

*Primary Examiner*—James F. Coan

*Attorney, Agent, or Firm*—Hopgood, Calimafde, Kalil, Blaustein & Judlowe

[57] ABSTRACT

This invention is a novel plastic bag and method of making it with a handle that extends upward through a folded-back top compartment, and the end of a front of the bag has a pocket with a similar folded-over top edge of the back of the bag. The bags of this invention are made from a continuous sheet, preferably a roll of plastic web that has its opposite side edges folded inwardly along opposite edges of the web to make the folded edges at the front and back sides of the bag. The web is then folded along its longitudinal center region with a gusset that forms the bottom of each bag. The bags have surfaces that are welded together to join areas of the front and of the back where necessary to weld plastic areas together, and certain areas do not weld where the plastic sheet is coated on areas that prevent heat applied to the plastic from fusing together.

12 Claims, 5 Drawing Figures

METHOD OF MAKING PLASTIC HANDLE BAGS FROM CONTINUOUS WEB

BACKGROUND AND SUMMARY OF THE INVENTION

Finished plastic packages are formed from sheet plastic material such as polyethylene or polyvinyl chloride. The sheet plastic is unrolled in a flat area with opposite longitudinal edges folded to form cuffs along what eventually form the top edges of the front and back panels of the bag. Edges of the bags are cut from successive bags along sides of the bags and where no connection is to be made, the web is coated with material that prevents the plastic from adjacent layers from fusing to one another.

The bags are made by folding a roll of plastic sheeting on a center line that runs longitudinally of the plastic roll as it is unrolled, and the plastic is folded along its longitudinal center line so that the fold is at the center of the bottom of each bag; and the material on opposite sides of the longitudinal center line become the front and back of the successive bags that are formed by severing the bags upon melting through the plastic to provide bags with welded edges at the sides of the bags. The folded longitudinal edges that are bent to form the cuffs along opposite edges of the roll of plastic provide upside-down pockets with slots at the upper fold lines and handles extending through the slots and having their opposite sides secured to the stiff handles that are longer than the slots and lift the bags by contact with the top folds, beyond the ends of the slots. The construction has a handle at the top of the front or back of the bag and a similar pocket at the top of the front or back that does not have a handle. A similar pocket that does not have the handle, does have a pocket with a slot that telescopes over the pocket with the handle to hold the bag closed by putting the handle through the slot in the pocket that has no handle to close the top of the bag as a neat package.

The sides of the bag are welded together by applying heat that welds the front and back panels where the bags are melted along lines of severance. In order to locate the pocket that has no handle in a convenient location for telescoping over the pocket that does have the handle, when closing the bag, surfaces of the bags that would weld together by the heat that cuts the individual bags apart has heat resistant lacquer applied to surfaces which are not to be welded to one another in the final assembly of the bag.

Other objects, features and advantages of the invention will appear or be pointed out as the description proceeds.

BRIEF DESCRIPTION OF DRAWING

In the drawing foming a part hereof, where corresponding parts are indicated by the same reference characters in all the views.

DESCRIPTION OF PREFERRED EMBODIMENT

Figure 1:
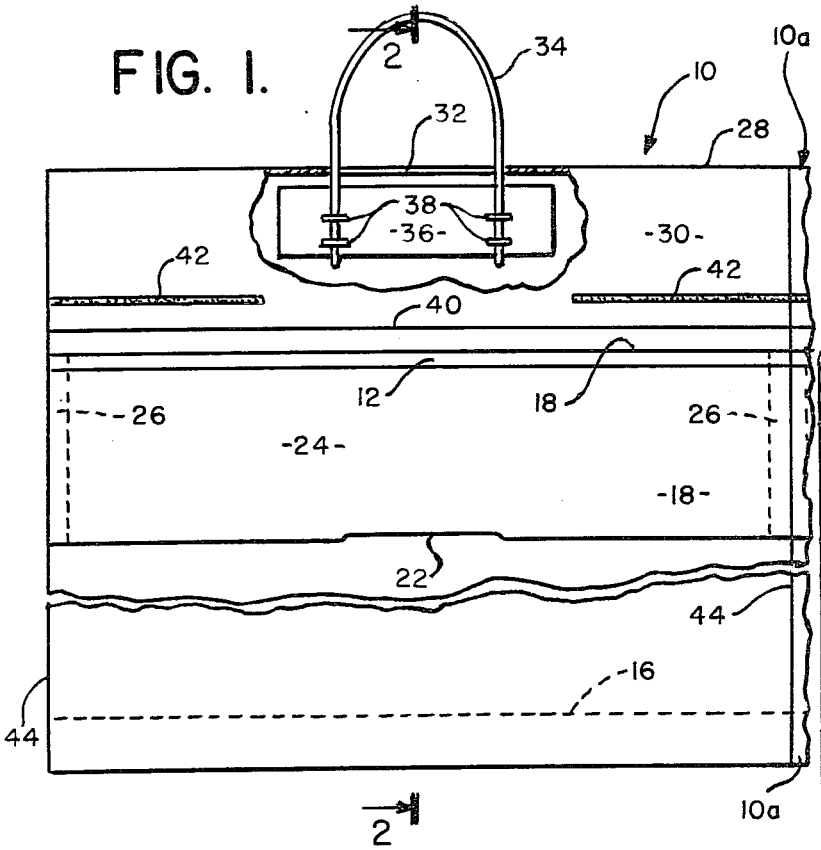
FIG. 1 is a fragmentary view of connected bags of this invention before being cut from one another at a station where successive bags have not yet been severed.

The bags 10 of this invention are preferably made of plastic such as high-density polyethylene, preferably of gauge thickness approximately 0.0015 to 0.0025 inches. The advantage of high-density polyethylene is that it is stiffer than low-density and is more like stiff paper, whereas the low-density polyethylene is floppy and less popular with customers who use the bags of this invention for a popular type of shopping bag. The outstanding advantage of plastic as compared with paper is that the plastic bags can be made by economical processes which permit individual welded bags to be made from large rolls of plastic webbing. The structure of an individual bag will be explained in connection with FIGS. 1 and 2, and the process for making it will be explained in connection with FIG. 4.

In the preferred construction, each bag 10 (FIG. 2) is made with a back sidewall 12 and a front sidewall 14 connected together at their lower ends by a gusset fold 16.

The upper portion of the front sidewall 14 is folded downward along a horizontal fold 18 to form a rearward panel 20 which then folds forward and upward at a fold line 22 to provide a front panel 24.

The confronting faces between the fold 18 and the fold 22 are coated with a layer of lacquer 26 shown as a heavy line between the two rearward panels that terminate at the lines 18 and 22, so that the panels coated with the lacquer 26 cannot become welded to one another during the final heating of the plastic material from which the bag is made, namely, when the bags are locally melted (a) to separate them from one another and (b) to seal the involved vertical edges of the bags when melted from one another along the alignment of their vertical edges.

The back sidewall 12 extends all the way to the top 28 where it folds over and extends downwardly. The top fold 28 has a slot 32 through which a handle 34 extends. The handle 34 is preferably made of a flexible tube or cord and is secured to a panel 36 by staples 38. The panel 36 is longer than the slot 32 so that both ends of the panel bear against the fold 28 beyond both ends of the slot 32.

The pocket 30 extends downward to its lower edge 40, and the top fold 28 is closed at both of its horizontal ends by welding of the panels of the bag and by additional welds 42 which connect the front of the pocket 30 to the back panel 12 to form the top pocket into a closed compartment except for the slot 32 and the space below the slot 32 through which the handle 34 and panel 36 can be inserted or removed from the bag.

Figure 3:
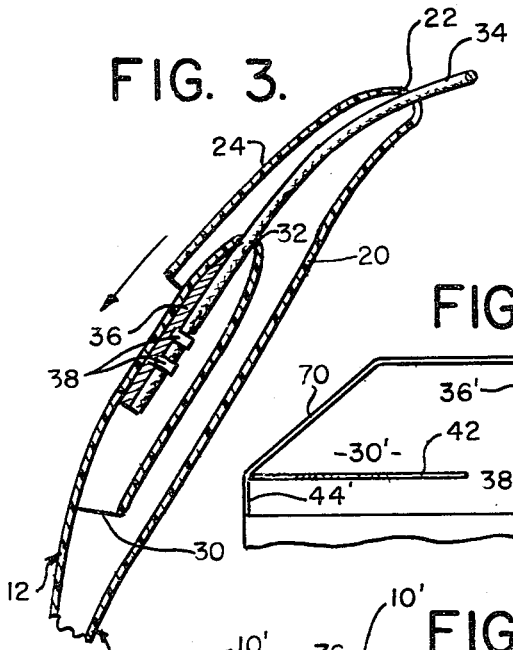
FIG. 3 shows the way in which the rearward top pocket has a handle which flexes forward, and the front pocket (right hand in FIG. 2) is telescoped over the rearward pocket and the handle, when the bag has been cut apart from the other bags and filled and closed.

When the bag is completed and severed along a line from the continuous line of similar bags, as will be explained in connection with FIG. 4, the finished bag is severed from the next bag **10*a* (FIG. 1) by fusing the plastic along the entire length of the line 44. The front panel 24 and the rearward panel 20 are pulled loose from the front sidewall 14 by swinging the panels 24 and 20 as indicated by the arrow 46 as shown in FIG. 3 and a slot at the fold line 22 between panels 20 and 24 can be swung into the position shown in FIG. 3 and then pulled downward, thereby enabling the front panels 20 and 24 to be moved to telescope with the pocket 30 and complete the closing of the bag. Space between the rearward sidewall 12 and the front sidewall 14 can be expanded to accomodate the articles placed in the bag by having the gusset 16** open up at its fold, thereby increasing the space within the bag.

Figure 4:
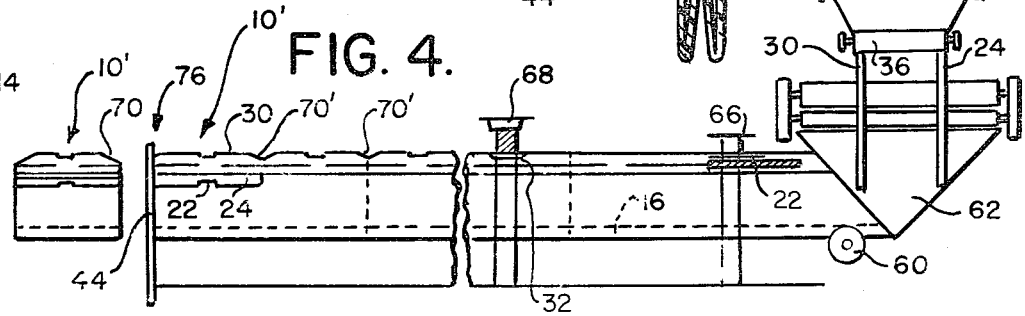
FIG. 4 is a diagrammatic showing, on a greatly reduced scale, showing the successive steps of the method of making the bags of this invention.

FIG. 4 shows diagrammatically the method by which the bag of this invention is produced. A roll 50 of plastic from which the bags are to be made is carried by supports 52. An applicator 26' is located in position to apply a non-fusable lacquer 26 to the surface of the outside convolution of the roll of plastic 50, at a location suitably positionable to apply the lacquer indicated by the reference character 26 in FIGS. 1 and 2. A folding tool 56 folds opposite edges of the roll 50 to form cuffs along both sides. These cuffs are indicated by the reference characters 24 and 30, in FIGS. 1, 2 and 4 of the drawing.

Figure 2:
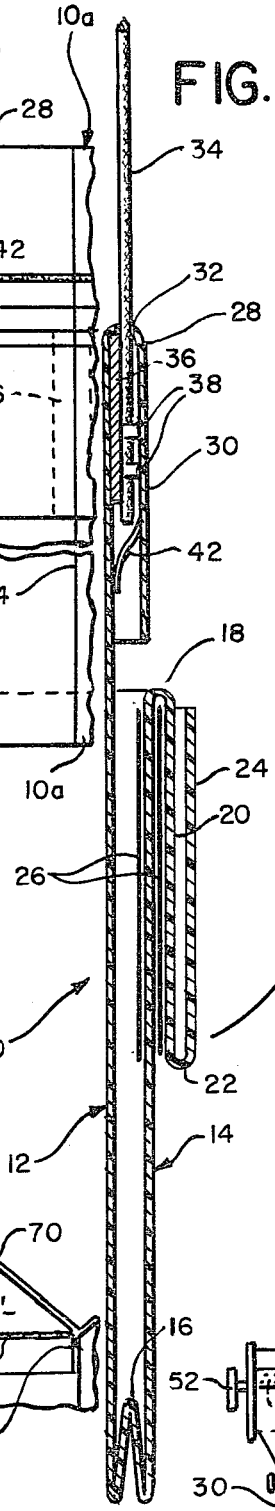
FIG. 2 is a greatly enlarged sectional view taken on the line 2—2 of FIG. 1.

A roller 60 near the apex of a former 62 folds the web 50 along its longitudinal center line to provide the gusset 16 (FIGS. 1, 2 and 4).

Cutters 66 and 68 cut the openings 22 and 32, handles 34 being later assembled and always extending extend when the handle is originally through the slots 32, and being adapted for later insertion and pulling through the slots 22, as shown in FIG. 3.

Successive bags 10 are cut from the connected line of bags at a cutting station 76 where heat is applied for the full height of the end bag along a line of severance 44. This cutting operation is applied along the line 44 of FIG. 1, and the line of bags is cut along the line 44 through all layers of the plastic. This cutting operation fuses the plastic on opposite sides of the line 44, except for the area 26 where lacquer was applied to prevent the lacquer-covered surfaces from welding together, as explained in connection with FIG. 2 and 3. In consequence, the lower front pocket is formed between panels 20 and 24, but no pocket is formed between front panel 14 and the pocket panel 20, the confronting faces of these panels 14–20 having been lacquer-insulated and, therefore, not heat-bonded or at least so weakly heat-bonded as to be readily openable, upon outward swinging movement of the lower front pocket, as suggested by the arrow 46, to perform the operation described in connection with FIG. 3.

Figure 5:
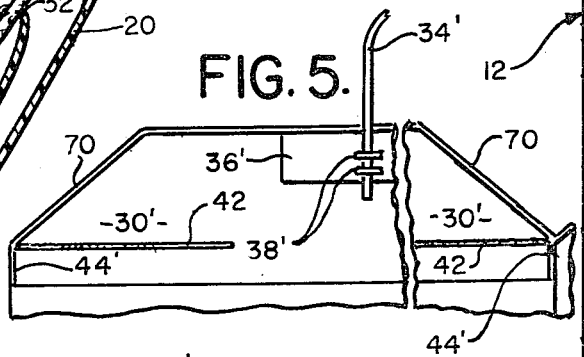
FIG. 5 is a modified construction.
Figure 5:
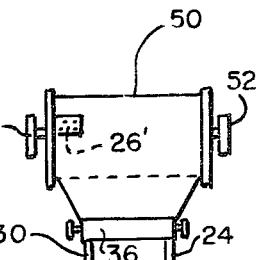

FIG. 1 shows the vertical edges of the bag 10 extending parallel to one another for the full height of the bag. However, in the modification of FIG. 5, the bag blanks have edges at opposite ends of a top panel 30' which slope so that what was the pocket 30 of FIG. 1 is in FIG. 5 trimmed off on side-edge sloping alignments 70 at both sides of the double layer defining the front and back panels of the pocket 30', the side edges 70 being fused together along their sloping edges. The welds 42 of FIG. 5 are the same as in the construction of FIG. 1, and in FIG. 4, wide-angle V-cuts 70', by local fusing at bag-width intervals, are shown to account for the sloping side edges 70 in the severed bag 10'. The cut off corners 70 will be understood to make it more convenient to pull the front pocket 20–24 over the top pocket 30'.

What is claimed is:

1. The method of making a bag having front and rear sidewalls, the upper end of the rear sidewall being folded forward and downward at its upper end and having a slot through which a handle is inserted with a lower part of the handle longer than the slot and in contact with the inside of the fold beyond both ends of the slot to support the bag from the handle, the upper end of the rear sidewall of the bag being a continuation of the lower part of the rear sidewall, the upper part of the front sidewall being folded downward over the lower part of the front sidewall and temporarily held against the lower part of the front sidewall, and holding the folded upper end of the front panel with its folded top edge below the folded down panel of the folded rearward panel until the handle has been inserted into the folded rearward panel and pushed up through the slot in the fold at the top of the rearward side of the bag, then turning the upper end of the folded front panel by pulling a temporary connection free of the lower portion of the front wall of the bag after the handle has been inserted through the slot in the top of the folded portion of the rearward panel, and closing the bag by placing the folded front portion of the cover over the folded rearward portion of the bag with the handle extending through a slot in the top of the forward folded end of the bag to hold the bag closed.

2. The method described in claim 1 characterized by the bag being made from a continuous web by advancing the web in the direction of the length of the web and folding the web transversely along one side thereof to form the folded down rearward portion at the upper end of the successive bags, and folding the web transversely along its opposite side to form a folded-up edge of the opposite side of the web, folding the web transversely upward from the first fold at said opposite side and then downwardly to provide areas of the web to form the folded front portion of the bag with folds over the upward fold of the rearward panel to close the bag when filled, folding the web transversely along three parallel lines extending in the direction of the length of the web to form a bottom of the bag with folds locate the front and back panel of successive bags with the original side edge of the web of the rearward fold above the original side edges of the web of the forward folds, severing the web transversely into successive bags and securing overlapped portions of the webs of successive bags to secure transverse edges of the top and bottom edge of the web to one another.

3. The method described in claim 2 characterized by making the bags of plastic material that melts to separate one bag from the next when the web is severed to separate successive bags from one another.

4. The method described in claim 3 characterized by sealing overlapping edges of the web to one another at the same time that the bags are cut apart.

5. The method described in claim 4 characterized by using a web made of high density polyethylene.

6. The method described in claim 4 characterized by the thickness of the web being of a gauge of approximately 0.0015 to 0.0025 inches.

7. The method described in claim 1 characterized by the front fold having its sides welded together at both sides of the bag and welded also to edges of both side edges of the bag by a weld that tears apart to permit the front fold to tear loose from the rest of the bag so that the front fold can swing upward to cover the rearward top fold after the handle is inserted through the slot in the top fold of the bag.

8. The method described in claim 2 characterized by placing a heat-resistant lacquer coat on the web at the location where successive bags are cut apart along a length of the bags between the sides of the folded front panels to prevent the edges of the folded front panels from welding to the material of the web when sides of the successive bags are welded together and side edges of the front folds are welded together to from opposite ends of the front folds to form pockets to open downward to the bottom of the bag and with corresponding pockets of the folds in the front of the bag forming pockets with their open ends facing the open ends of the pockets of the rearward walls of the bags at locations spaced about the same distance from the top of the bags so that the front pocket can swing upward to fit over the rearward upper pocket to close the bags.

9. The method described in claim 8 characterized by the rearward pocket of each bag having a fold at its upper end with a slot in the fold long enough to receive a handle, and base for the handle attached to the lower ends of the handle which are located in the rearward top pocket and which extend within the rear folded pocket and beyond both ends of the slot to prevent the handle from pulling out of the bag in an upward direction, the pocket on the front of the bag having its open end just below the open end of the pocket in the rearward side of the bag and in position so that the pocket in the front wall of the bag can be swung upwardly and over the top of the pocket in the rearward side of the bag, and a slot in the front pocket in position to permit the handle to extend through the slot in the front pocket to hold the bag closed.

10. The method of making a bag having front and rear sidewalls, the upper end of the rear sidewall being folded forward and downward at its upper end and having a slot through which a handle is inserted with a lower part of the handle longer than the slot and in contact with the inside of the fold beyond both ends of the slot to support the bag from the handle, the upper end of the rear sidewall of the bag being a continuation of the lower part of the rear sidewall, the upper part of the front sidewall being movably folded downward over the lower part of the front sidewall and against the lower part of the front sidewall, which method comprises holding the folded upper end of the front panel with its folded top edge below the folded down panel of the folded rearward panel until the handle has been inserted into the folded rearward panel and pushed up through the slot in the fold at the top of the rearward side of the bag, then turning the upper end of the folded front panel by unfolding the same upward from the lower portion of the front wall of the bag after the handle has been inserted through the slot in the top of the folded portion of the rearward panel, and closing the bag by placing the now-unfolded front portion of the cover over the folded rearward portion of the bag with the handle extending through a slot in the top of the now-unfolded folded end of the bag to hold the bag closed.

11. The method of claim 10, in which said bag is made by severance from a single continuously advancing sheet from a roll of plastic, wherein each of the front and rear sidewalls and the folded upper portions thereof are folded-over cuffs on opposite sides of the sheet of plastic, the bags being heat-welded and severed at a melting station on a single alignment transverse to the cuffed sheet.

12. The method of claim 11, in which at a station in advance of the melting station a substance is locally applied to the plastic to prevent fusion with adjacent contacted cuffed plastic, the local application being where portions of successive bags are not to be welded at the melting station.

* * * * *